US010155648B1

(12) United States Patent
Lewis et al.

(10) Patent No.: US 10,155,648 B1
(45) Date of Patent: Dec. 18, 2018

(54) DEVICE FOR DISPENSING A BEVERAGE

(71) Applicants: Michael Edward Lewis, Fishers, IN (US); Matt Allen Griffith, Indianapolis, IN (US); Duyane Thomas Waggoner, Westfield, IN (US)

(72) Inventors: Michael Edward Lewis, Fishers, IN (US); Matt Allen Griffith, Indianapolis, IN (US); Duyane Thomas Waggoner, Westfield, IN (US)

( * ) Notice: Subject to any disclaimer, the term of this patent is extended or adjusted under 35 U.S.C. 154(b) by 0 days.

(21) Appl. No.: 15/342,723

(22) Filed: Nov. 3, 2016

Related U.S. Application Data

(60) Provisional application No. 62/250,282, filed on Nov. 3, 2015.

(51) Int. Cl.
*B67D 1/00* (2006.01)
*B67D 1/08* (2006.01)

(52) U.S. Cl.
CPC ..... *B67D 1/0082* (2013.01); *B67D 1/0004* (2013.01); *B67D 1/0891* (2013.01); *B67D 2001/0088* (2013.01); *B67D 2001/0827* (2013.01)

(58) Field of Classification Search
CPC .. B67D 1/0082; B67D 1/0004; B67D 1/0891; B67D 2001/0827; B67D 2001/0088
See application file for complete search history.

(56) References Cited

U.S. PATENT DOCUMENTS

| | | | | |
|---|---|---|---|---|
| 3,323,580 | A | 5/1965 | Ehlers | |
| 3,428,218 | A | 5/1966 | Coja | |
| 4,947,739 | A | 8/1990 | Owen | |
| 6,003,742 | A * | 12/1999 | Garcia | B65D 47/2025 222/508 |
| 6,059,143 | A * | 5/2000 | Weir | A45F 3/00 222/184 |
| 7,464,567 | B1 | 12/2008 | Crossley | |
| 8,459,503 | B2 | 6/2013 | Groesbeck | |
| 2012/0199013 | A1 * | 8/2012 | Gutierrez | B01F 3/04503 99/323.1 |

* cited by examiner

*Primary Examiner* — Donnell Long
(74) *Attorney, Agent, or Firm* — Indiana University Maurer School of Law IP Legal Clinic

(57) ABSTRACT

A device for controlling the dispensing of a beverage is provided. The device is configured to control the dispensing of a bag-in-box beverage and includes a removable adaptor for attachment to a push button operated beverage dispensing valve. The removable adaptor includes a base with interior passageway, a plurality of clamp members to releasably secure the removable adaptor to the beverage dispensing valve, and a depression member with a depression extension for depressing the push button of the beverage dispensing valve.

10 Claims, 15 Drawing Sheets

DEVICE FOR DISPENSING A BEVERAGE

CROSS-REFERENCE TO RELATED APPLICATIONS

The present application claims the benefit of U.S. Provisional Patent Application No. 62/250,282 to Lewis et al., entitled "Device for Dispensing a Beverage," and filed on Nov. 3, 2015, which is hereby incorporated by reference in its entirety.

TECHNICAL FIELD OF THE DISCLOSED EMBODIMENTS

The embodiments herein generally relate to a device for controlling the dispensing of a beverage and, more particularly, to a device configured to control the dispensing of a bag-in-box beverage.

BACKGROUND OF THE DISCLOSED EMBODIMENTS

Generally, bag-in-box packaging is used for storing, transporting, and dispensing various types of beverages. The beverage is contained within a vacuum-sealed plastic bladder that holds the beverage and keeps it fresh. The plastic bladder is packaged within a protective corrugated fiberboard box which protects the beverage contents and advertises the brand. Some bag-in-box beverage containers also include an air-tight valve emerging from the corrugated fiberboard box that allows for dispensing the beverage.

According to the present disclosure, various adaptors are disclosed to dispense beverage from bag-in-box packaging.

BRIEF DESCRIPTION OF DRAWINGS

The embodiments described herein and other features, advantages and disclosures contained herein, and the manner of attaining them, will become apparent and the present disclosure will be better understood by reference to the following description of various exemplary embodiments of the present disclosure taken in conjunction with the accompanying drawing, wherein.

DETAILED DESCRIPTION OF THE DISCLOSED EMBODIMENTS

Figure 1:
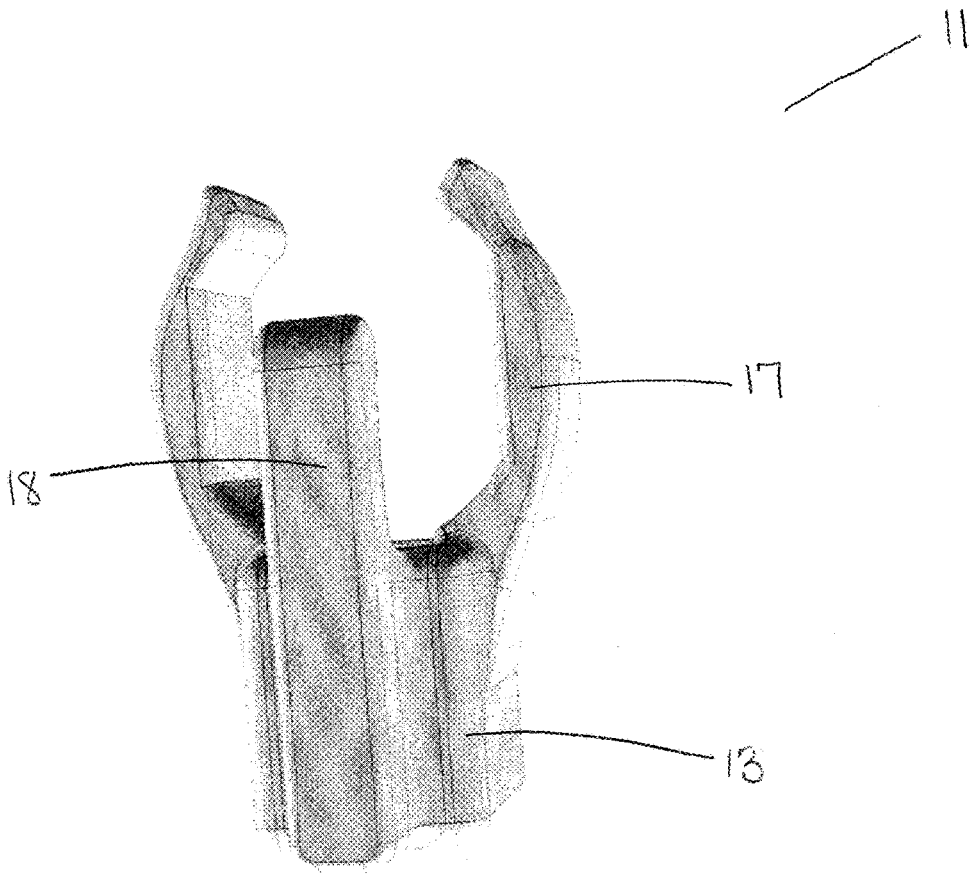
FIG. 1 is a front-side perspective view of a removable adaptor in accordance with an embodiment.
Figure 2:
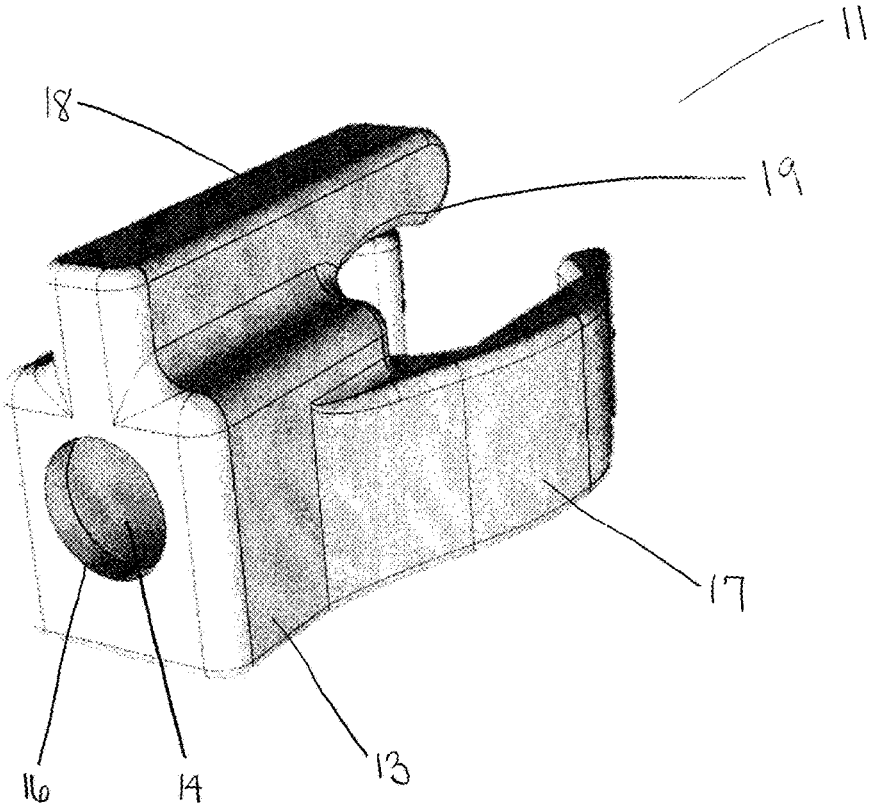
FIG. 2 is a bottom-side perspective view of a removable adaptor in accordance with an embodiment.
Figure 3:
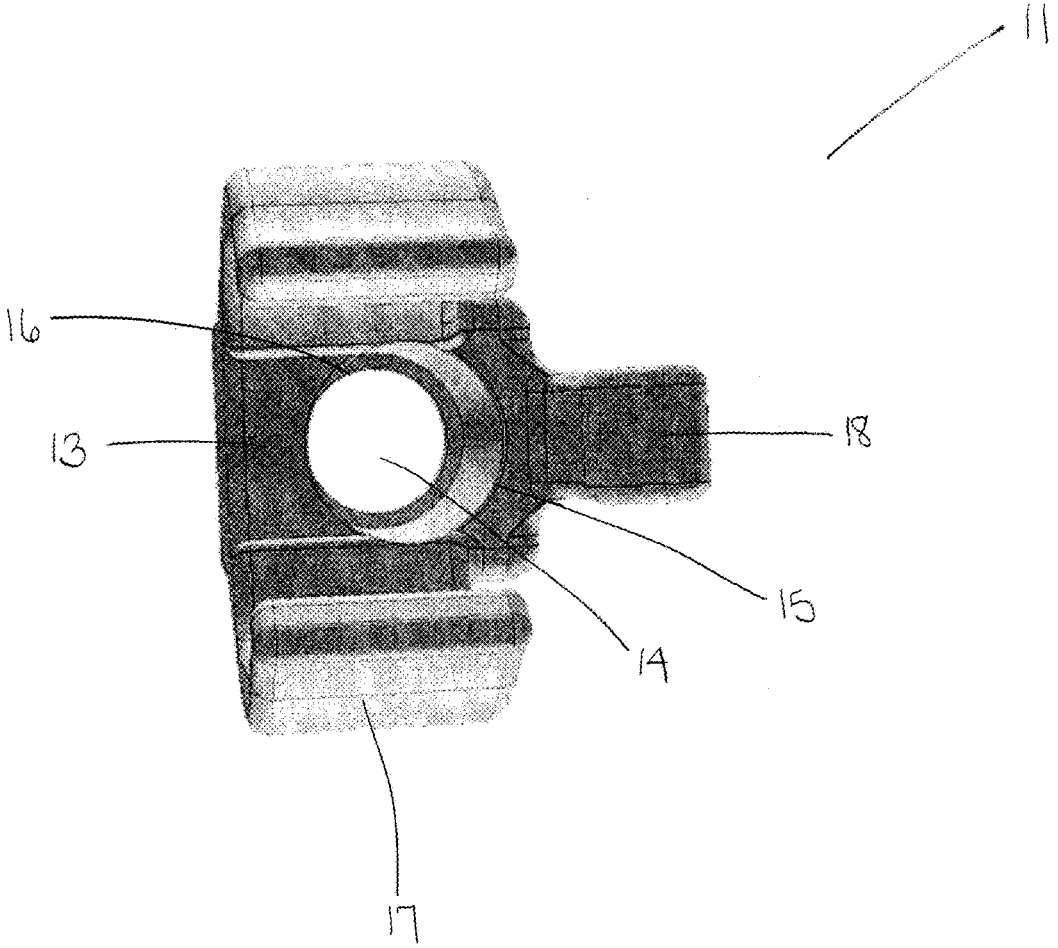
FIG. 3 is a top perspective view of a removable adaptor in accordance with an embodiment.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Figure 14:
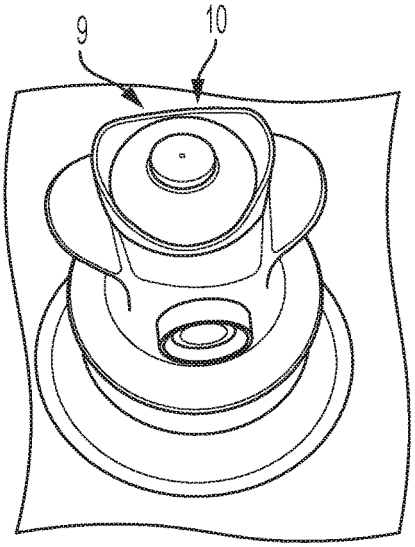
FIG. 14 is a perspective view of a dispensing valve with a push button for a bag-in-box beverage container.
Figure 15:
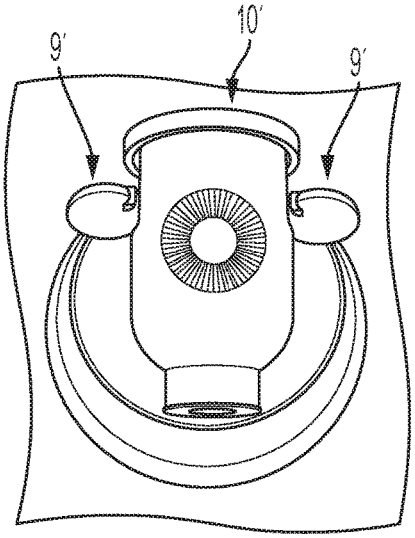
FIG. 15 is a perspective view of a dispensing valve with tabs for a bag-in-box beverage container.
Figure 16:
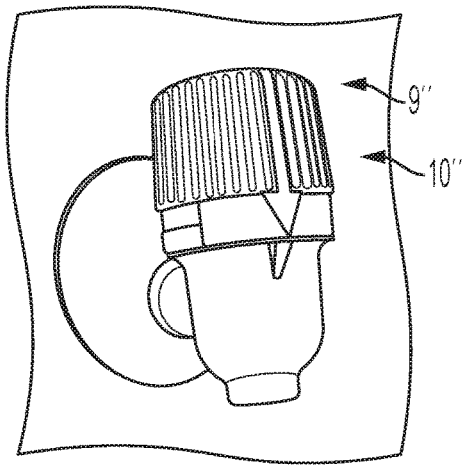
FIG. 16 is a perspective view of a twist dispensing valve of a bag-in-box beverage container.

FIGS. 1-4 illustrate one embodiment of a removable adaptor 11 for controlling the dispensing of a beverage from a dispensing valve 10 of a bag-in-box beverage container 7. Three types of dispensing valves 10, 10', and 10" are shown in FIGS. 14-16. Dispensing valve 10 of FIG. 14 includes a push button 9 that is depressed to open valve 10 to allow liquid to flow from the bag-in-box container 7. Dispensing valve 10' of FIG. 15 includes a pair of tabs 9' that are pressed up to allow liquid to flow. Dispensing valve 10" of FIG. 16 includes a knob 9" that is twisted to allow liquid to flow.

Figure 4:
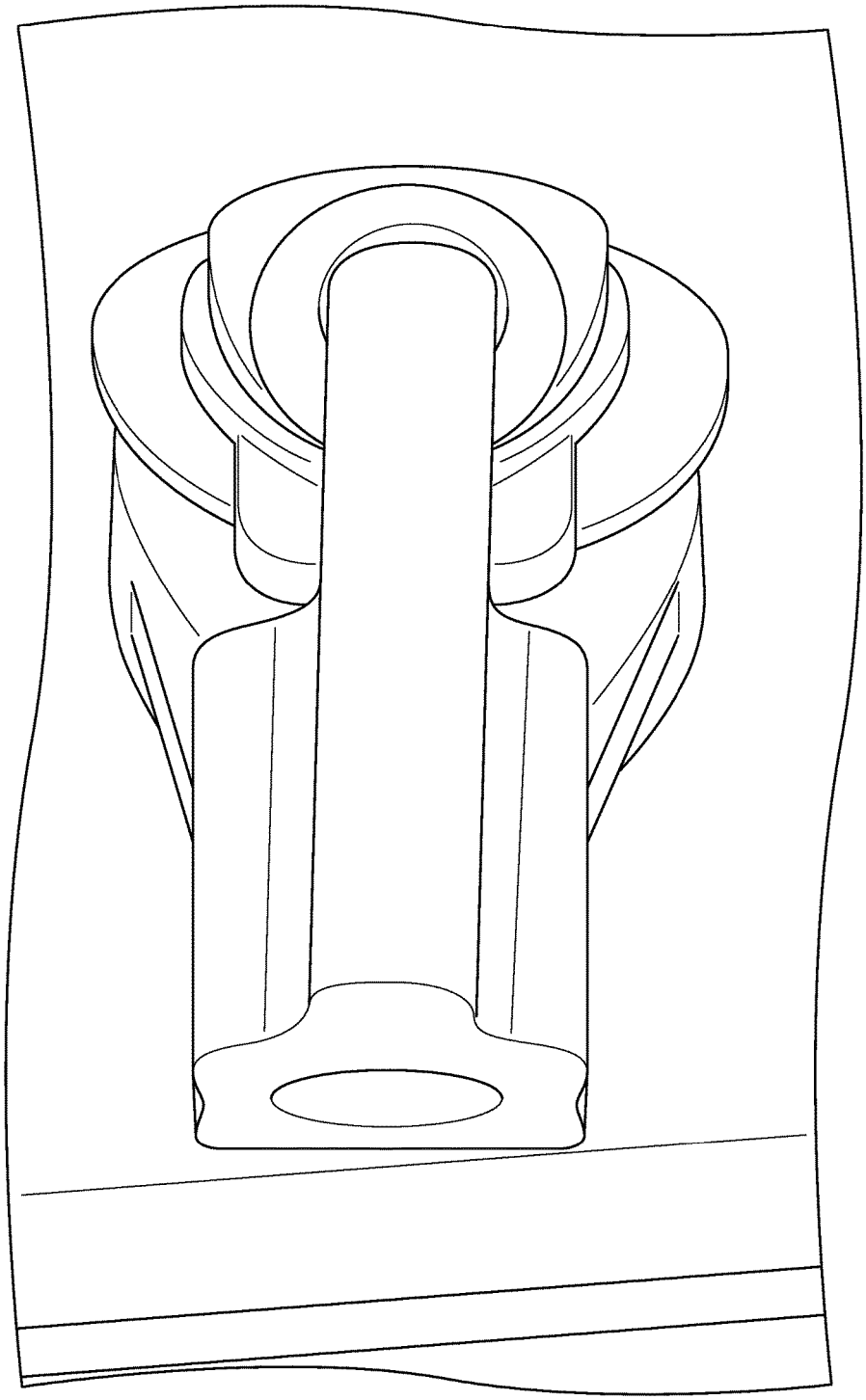
FIG. 4 shows a removable adaptor secured to a dispensing valve of a bag-in-box beverage container in accordance with an embodiment.

Referring again to FIGS. 1-4, removable adaptor 11 comprises a base 13 with an interior passageway 14 such that base 13 comprises an inlet 15 and outlet 16. Removable adaptor 11 further comprises outer clamp members 17 and depression member 18. Outer clamp members 17 curve up vertically from each side of base 13 to form a C-shaped clamp for securing removable adaptor 11 to dispensing valves 10, 10', 10" of bag-in-box beverage container 7, as illustrated in FIG. 4. Depression member 18 extends vertically along the front of base 13 in the same direction as the C-shaped clamp. Depression member 18 is rigidly connected to base 13 and comprises depression extension 19 for depressing push button 9 of dispensing valve 10 of bag-inbox beverage container 7 such that contact of depression extension 19 with push button 9 of dispensing valve 10 opens dispensing valve 10 and thereby provides for continuous flow of beverage out of dispensing valve 10 and into interior passageway 14 of removable adaptor 11.

The interior passageway 14 of base 13 allows for transport of the beverage out of dispensing valve 10 of bag-in-box beverage container 7 into interior passageway 14. FIG. 4 shows an embodiment of a removable adaptor 11 secured to dispensing valve 10 of a bag-in-box beverage container 7. When removable adaptor 11 is secured to dispensing valve 10 of a bag-in-box beverage container 7 by clamping outer clamp members 17 around dispensing valve 10, the spout of dispensing valve 10 is recessed into interior passageway 14 at inlet 15. Inlet 15 may also include an o-ring (not shown) in some embodiments that surrounds the spout at the point it enters inlet 15 of interior passageway 14. When removable adaptor 11 is secured to dispensing valve 10 of bag-in-box beverage container 7, depression extension 19 of depression member 18 engages and depresses push button 9 of dispensing valve 10, thereby opening dispensing valve 10, allowing beverage to flow from bag-in-box beverage container 7.

Figure 5:
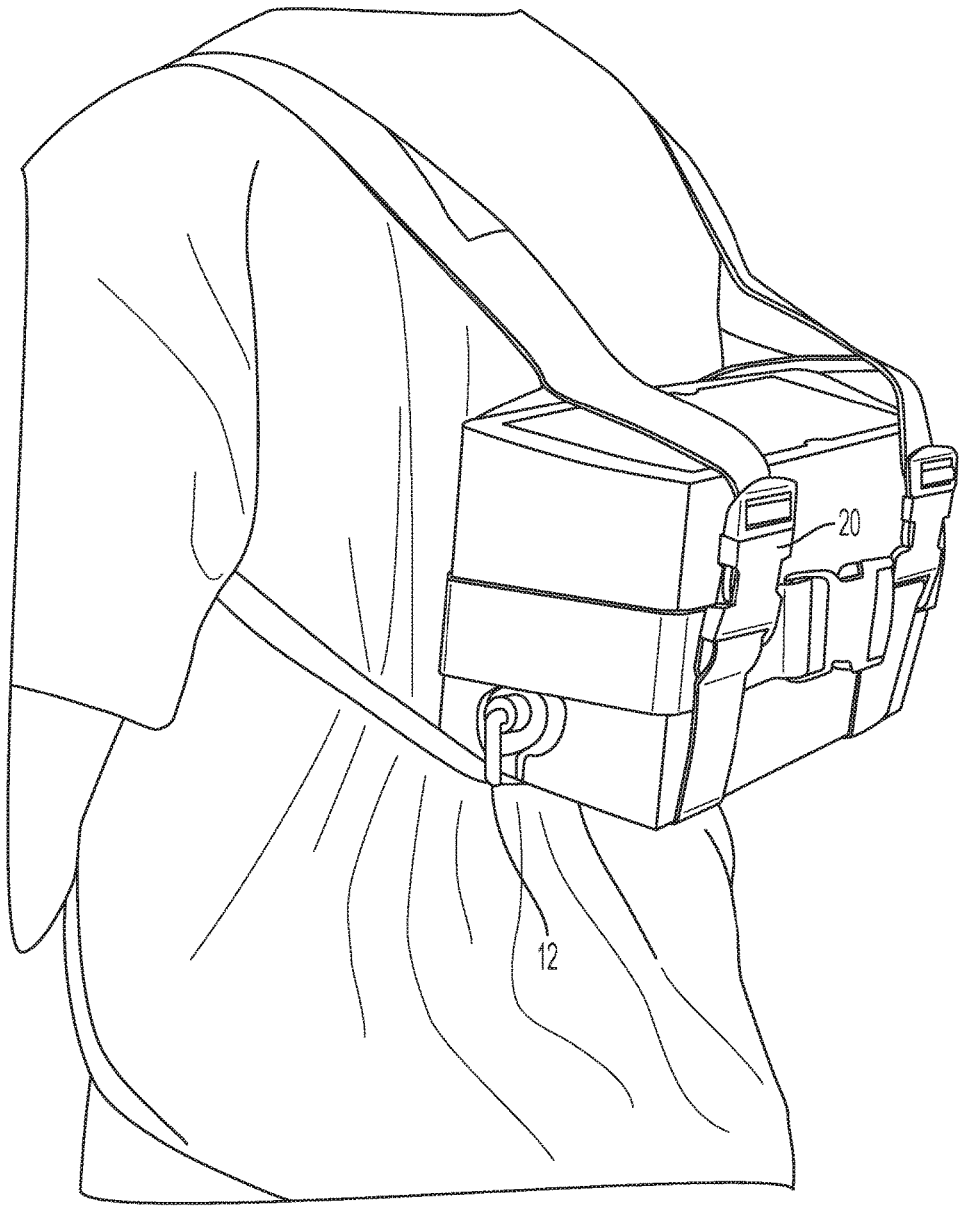
FIG. 5 shows a device for controlling dispensing of a beverage in accordance with an embodiment.
Figure 6:
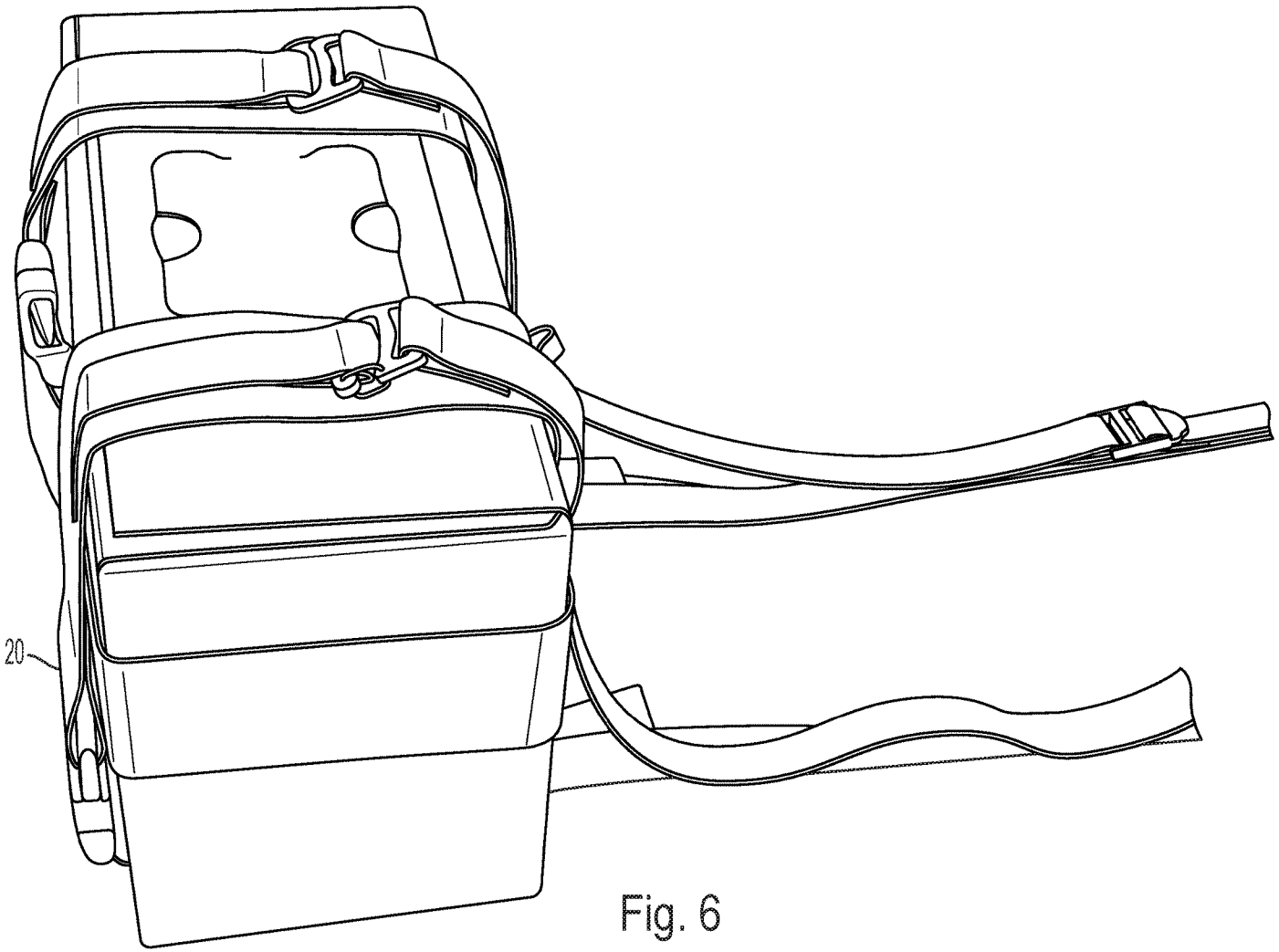
FIG. 6 shows an adjustable backpack for securely transporting a bag-in-box beverage container in accordance with an embodiment.

With reference to FIGS. 5 and 6, removable adaptor 11 is shown coupled to a detachable tube 12. In some embodiments tube 12 is not detachable, but is instead integrally formed with removable adaptor 11. Outlet 16 of interior passageway 14 allows for a detachable tube 12 to be inserted into interior passageway 14 such that a beverage dispensed into removable adaptor 11 travels into detachable tube 12 and out the remote end of detachable tube 12. Therefore, the beverage flows out of the spout of dispensing valve 10 of bag-in-box beverage container 7 through depression of push button 9 on dispensing valve 10 via depression extension 19 of depression member 18. Then the beverage flows into removable adaptor 11 through inlet 15 of interior passageway 14 and out through detachable tube 12 inserted into interior passageway 14 at outlet 16.

Some embodiments include a backpack 20 for securing a bag-in-box beverage container 7 such that an individual can carry bag-in-box beverage container 7 hands-free. In some embodiments, backpack 20 may be adjustable in size to accommodate various sizes of bag-in-box beverage containers 17. For example, backpack 20 may be formed from elongated members 120 that wrap around bag-in-box beverage container 7, and adjustment members 121, such as strap adjusters or hook-and-loop fasteners, to name just two non-limiting examples, may be used to adjust the length of elongated members 120. An individual carrying bag-inbox beverage container 7 via backpack 20 can dispense the beverage through the remote end of detachable tube 12. The beverage is gravity fed from dispensing valve 10 of bag-inbox beverage container 7 through removable adaptor 11 and detachable tube 12 such that an individual holding the remote end of detachable tube 12 can control the amount and timing for dispensing the beverage. The remote end of detachable tube 12 may be provided with a valve (not shown) to allow the user to easily control the dispensing of the beverage.

Figure 7:
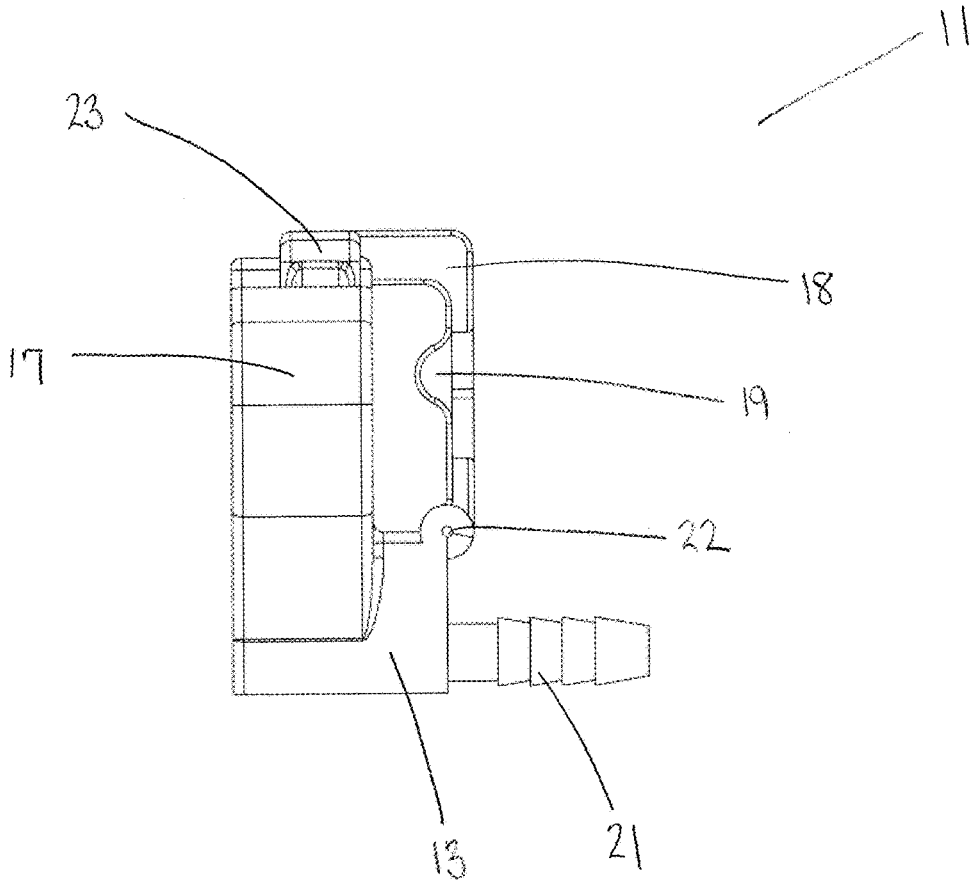
FIG. 7 is a side perspective view of a two-piece removable adaptor in accordance with an embodiment.
Figure 8:
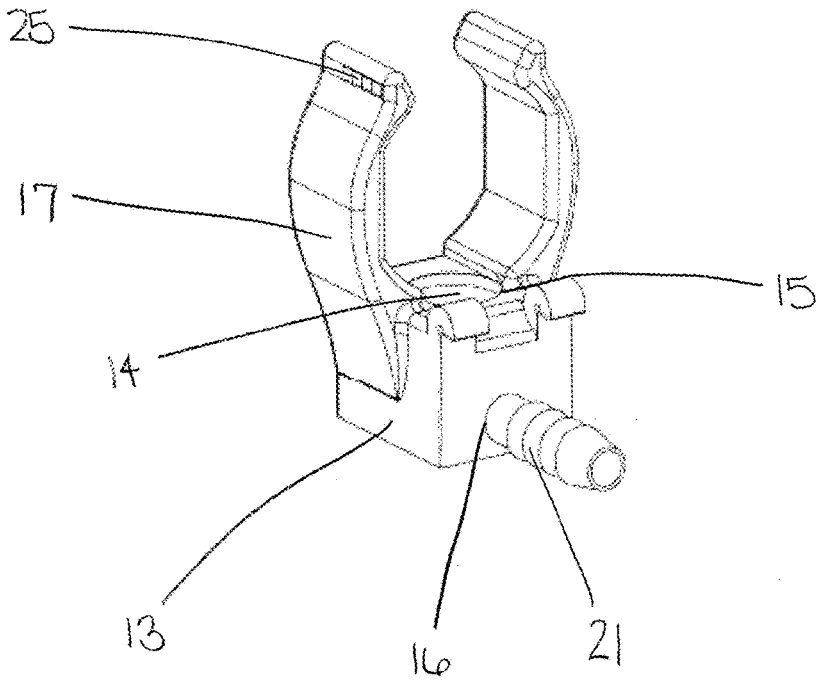
FIG. 8 is a front-side perspective view of a two-piece removable adaptor without the depression member in accordance with an embodiment.
Figure 9:
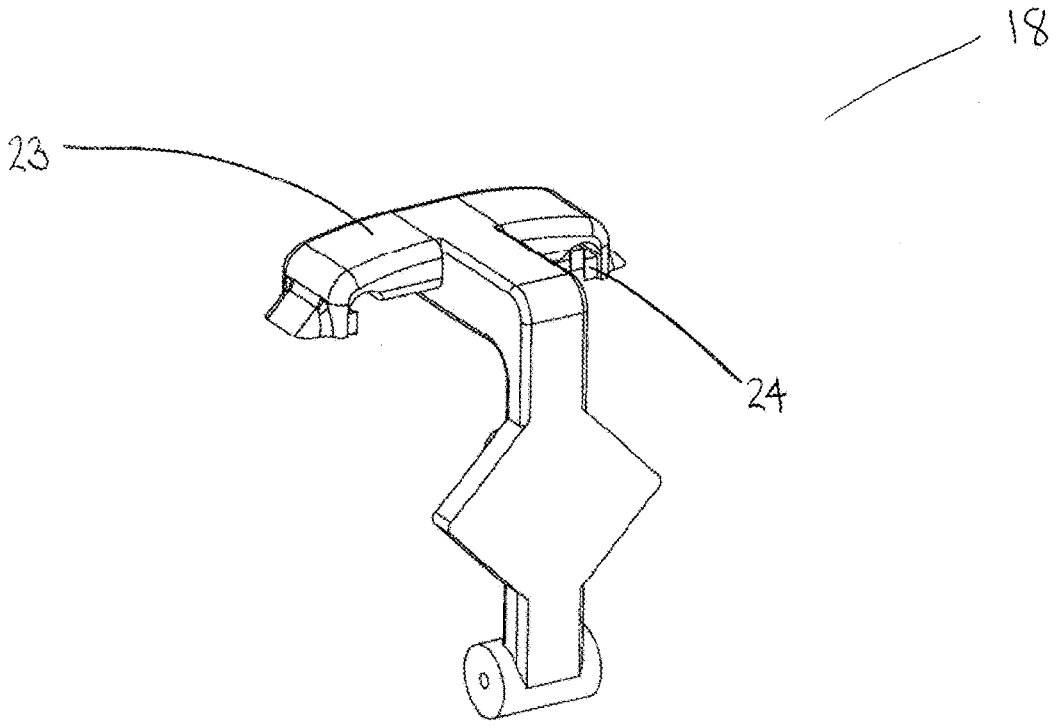
FIG. 9 is a front-side perspective view of a depression member of a two-piece removable adaptor in accordance with an embodiment.

FIGS. 7-9 illustrate another embodiment of a removable adaptor 11 for controlling the dispensing of a beverage. This embodiment is in accordance with the above description; however, outlet 16 of removable adaptor 11 is located on the front of base 13 on the side facing away from bag-in-box beverage container 7. This embodiment may further include at outlet 16 a tube connector 21 for securing detachable tube 12 to removable adaptor 11. Depression member 18 of this embodiment is separate from base 13 and connected thereto by a hinge 22. Depression member 18 further includes a fastening member 23 for securing depression member 18 to outer clamp members 17. This embodiment allows for alternating between a fastened position where depression member 18 is secured to outer clamp members 17 and an unfastened position where depression member 18 is not secured to outer clamp members 17. In the fastened position, depression extension 19 of depression member 18 depresses push button 9 of dispensing valve 10 on bag-in-box beverage container 7 such that the beverage can be dispensed according to the method described above. In the unfastened position, depression extension 19 of depression member 18 does not depress push button 9, such that dispensing valve 10 is closed and the beverage is not dispensed. With this embodiment, removable adaptor 11 does not need to be removed from dispensing valve 10 in order to stop the flow of the beverage from bag-in-box beverage container 7 when not in use.

In this embodiment, fastening member 23 comprises teeth 24. Outer clamp members 17 also include teeth 25 at their distal ends such that when depression member 18 is in a fastened position, teeth 24 of fastening member 23 interlock with teeth 25 of outer clamp members 17 to secure depression member 18 to outer clamp members 17. Additionally, the position of depression member 18 when in the fastened position can be further adjusted by changing the alignment of teeth 24 of fastening member 23 relative to teeth 25 of outer clamp members 17. This position adjustment allows for removable adaptor 11 to be adapted to the configuration of push button 9 of a dispensing valve 10 of various configurations of bag-in-box beverage containers 7.

Figure 10:
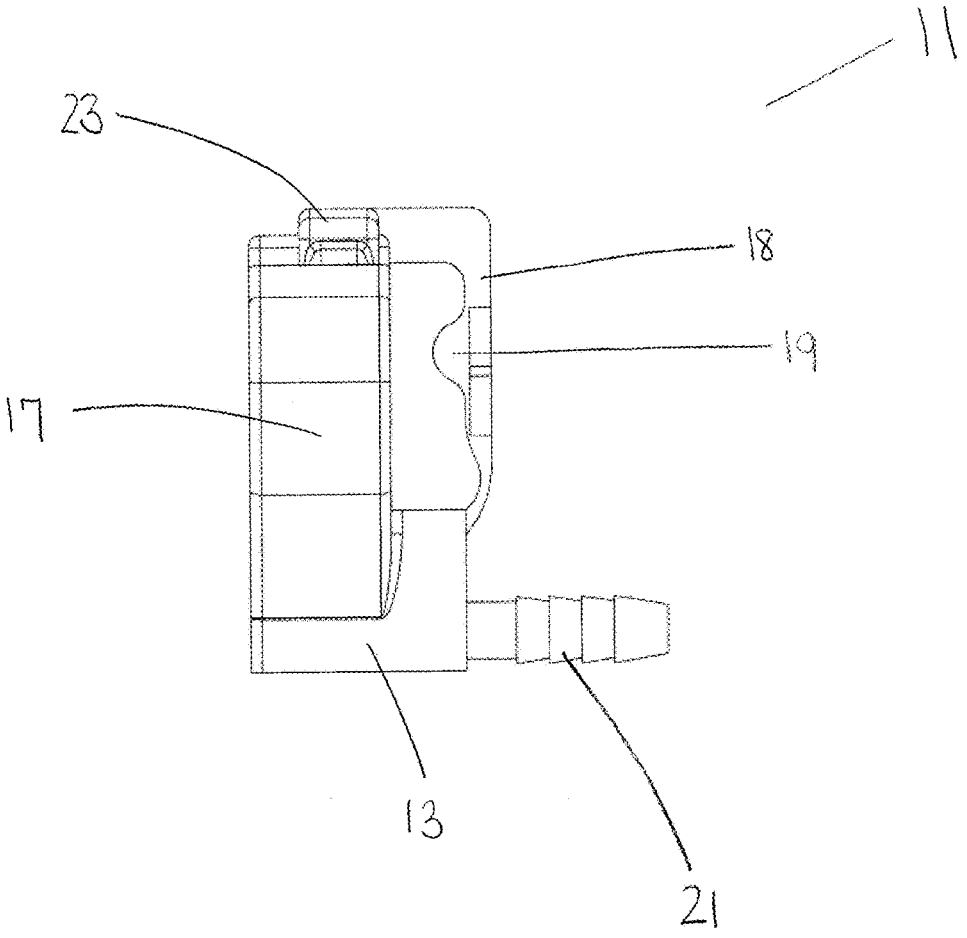
FIG. 10 is a side perspective view of a one-piece removable adaptor in accordance with an embodiment.
Figure 11:
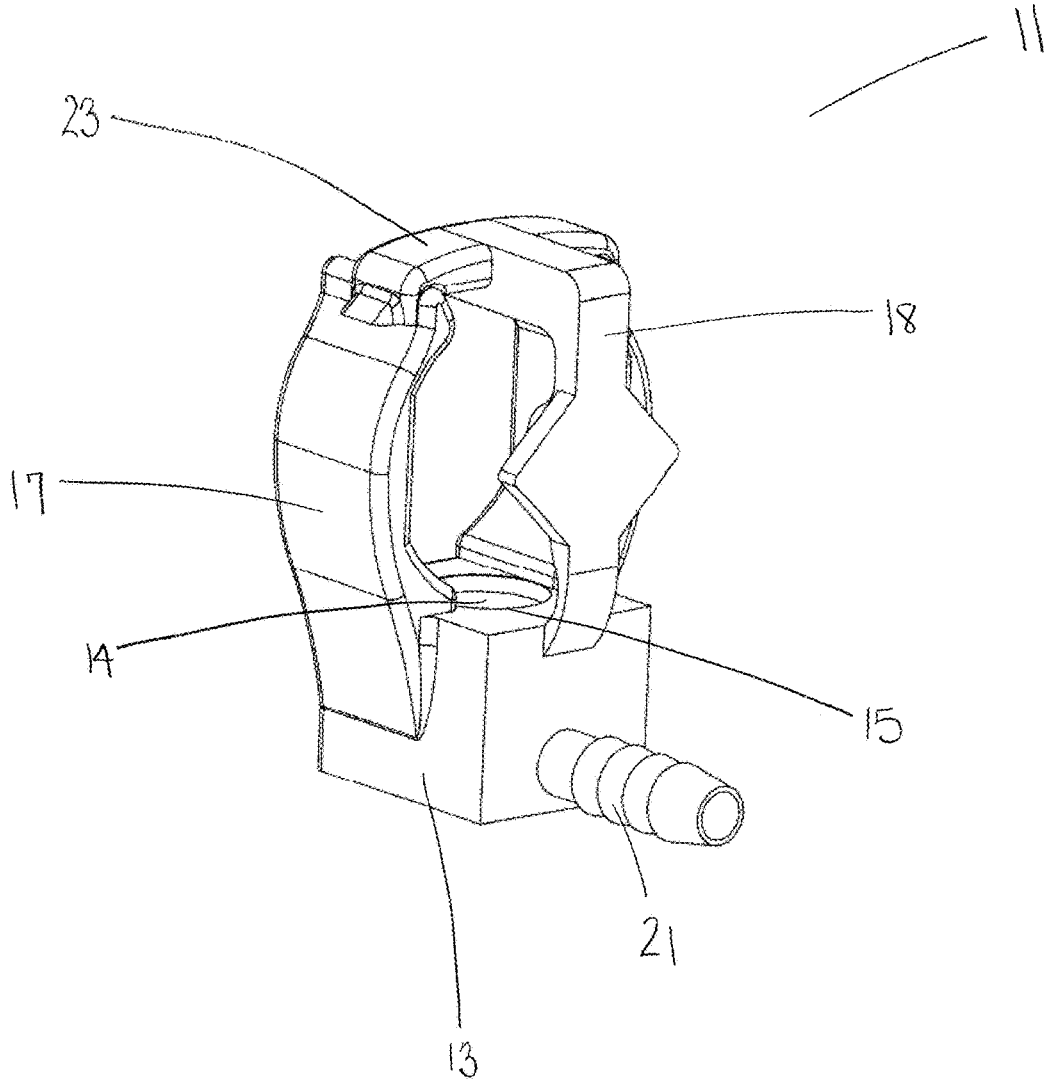
FIG. 11 is a front-side perspective view of a one-piece removable adaptor in accordance with an embodiment.

FIGS. 10 and 11 depict a further embodiment in which depression member 18 is flexibly connected to base 13. As described above, depression member 18 can alternate between a fastened and unfastened position. However, depression member 18 is permanently and flexibly connected to base 13 without the need for a two-part hinge or other connection device.

Figure 12:
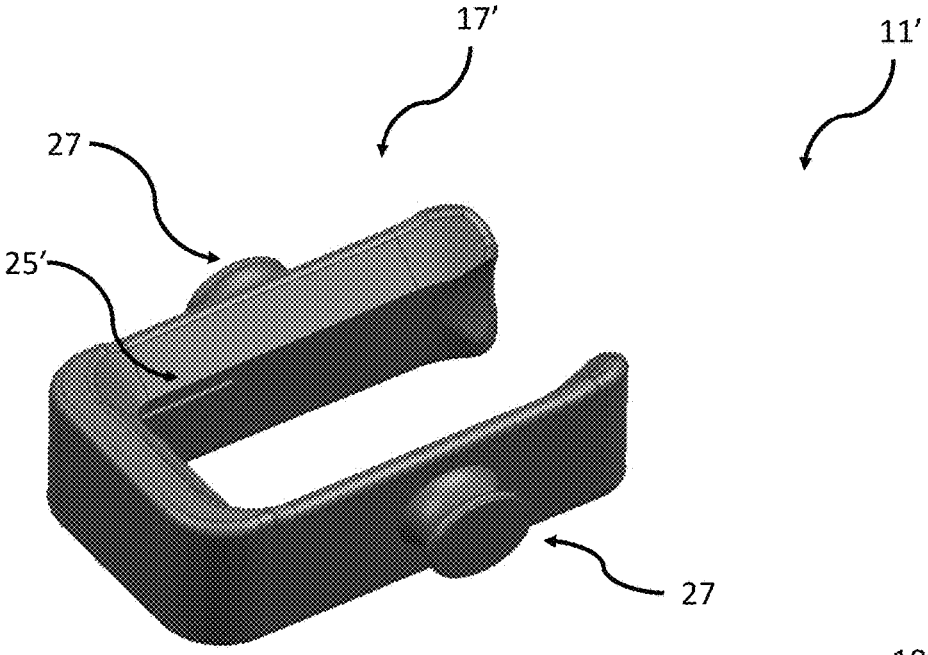
FIG. 12 is a side perspective view of base of a two-piece adaptor in accordance with an embodiment.
Figure 13:
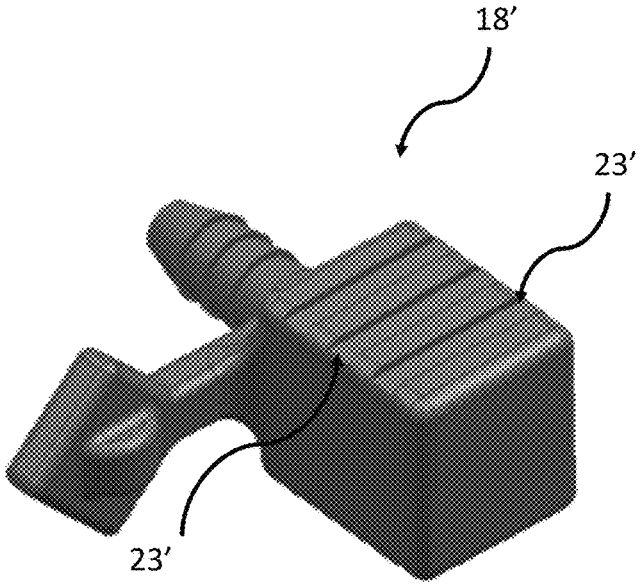
FIG. 13 is a top perspective view of a depression member of the two-piece adaptor of FIG. 12.

FIGS. 12 and 13 illustrate another embodiment of a removable adaptor 11' for controlling the dispensing of a beverage. This embodiment is in accordance with the above description; however, slide/depression member 18' slides onto clamp member 17'. As shown in FIG. 13, depression member 18' includes a plurality of grooves 23' and clamp member 17' includes a pair of lugs 25' (only one shown) on opposite interior sides of clamp member 17'. To assembly adaptor 11', depression member 18' is slid into clamp member 17' so that lugs 25' align with one set of grooves 23'. Selection of the pair of grooves 23' to which lugs 25' are aligned determines the relative position of clamp member 17' and depression member 18' to determine the depth at which depression member 18' depresses push button 9 (see FIG. 17). Thus, depending on the location of push button 9 relative to the rest of container 7, the appropriate pair of grooves 23' can be selected.

A receiving end of clamp member 17' is slightly narrowed so that when depression member 18' is completely received in clamp member 17' and positioned over dispensing valve 10, the receiving end snaps back to its original size to secure dispensing valve 10 and depression member 18' within clamp member 17'.

Figure 17:
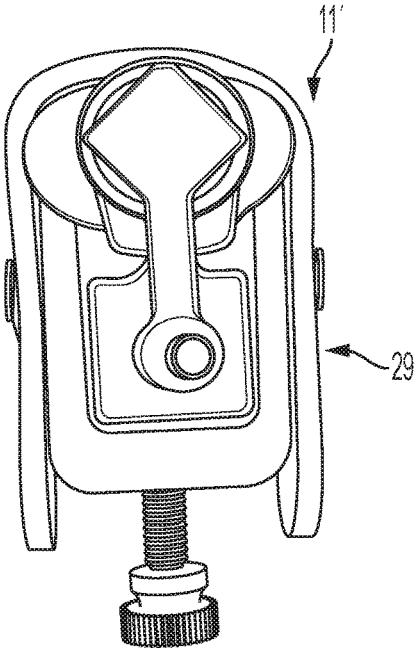
FIG. 17 is a side view of the adaptor of FIGS. 12 and 13 positioned on the push button dispensing valve of FIG. 14.
Figure 18:
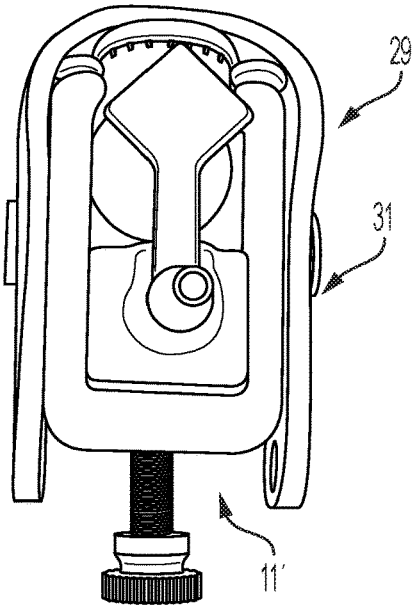
FIG. 18 is a side view of the adaptor of FIGS. 12 and 13 positioned on dispensing valve of FIG. 15.
Figure 19:
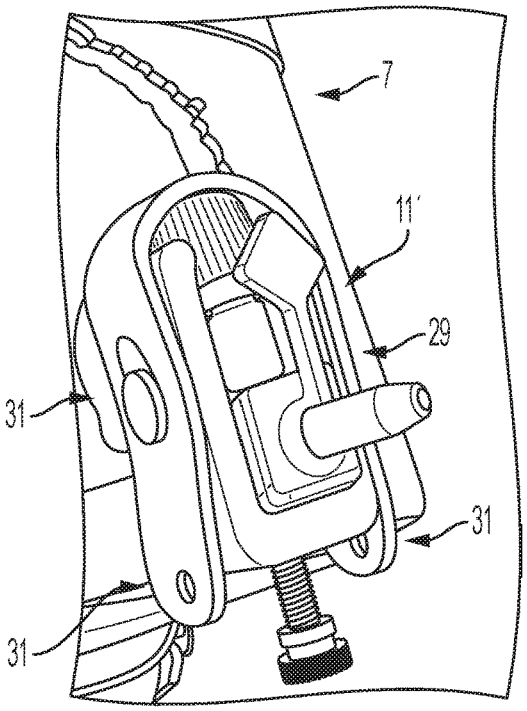
FIG. 19 is a side perspective view of the adaptor of FIGS. 12 and 13 positioned on the twist dispensing valve of FIG. 14.

Clamp body 18' includes a pair of posts 27. To assist in securing adaptor 11' to a bag-in-box container, a flexible rubber strap 29 having a plurality of holes 31 is provided. One of posts 27 is inserted into one of holes 31 in strap 29. As shown in FIGS. 17-19, strap 29 extends over a dispensing valve 10, 10', 10" of bag-in-box container 7 and the other post 27 is inserted another hole 31 in strap 29. Preferably strap 29 is stretched while posts 27 are inserted into 31 holes to hold adaptor 11' securely to dispensing valve 10, 10', 10". As shown in FIG. 18, strap 29 pushes down on the top of dispensing valve 10' so that tabs 9' are pushed up by the top of clamp body 18' to open dispensing valve 10'. As shown in FIG. 19, twist dispensing valve 10" is secured within clamp body 18' by strap 29. As shown in FIGS. 17-19, adaptor 11' may also include a screw 33 received by clamp body 18'. When screwed in, an end of screw 33 pushes on depression member 18' to adjust the position of depression member 18' relative to clamp body 18' which adjusts the relative position of dispensing valve 10, 10', 10" relative to clamp body 18'.

Figure 20:
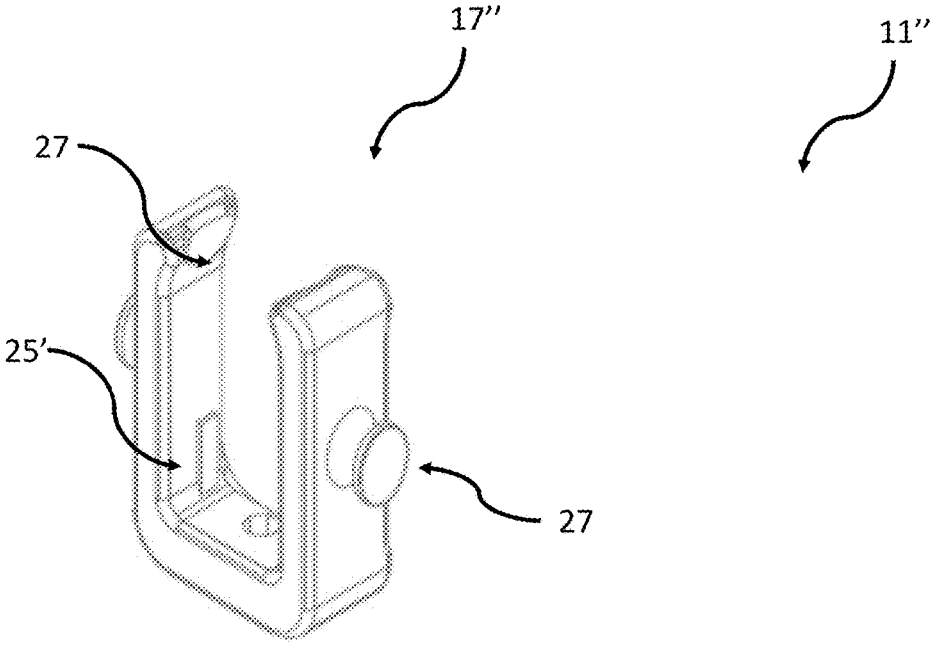
FIG. 20 is a perspective view of base of a two-piece adaptor in accordance with an embodiment.
Figure 21:
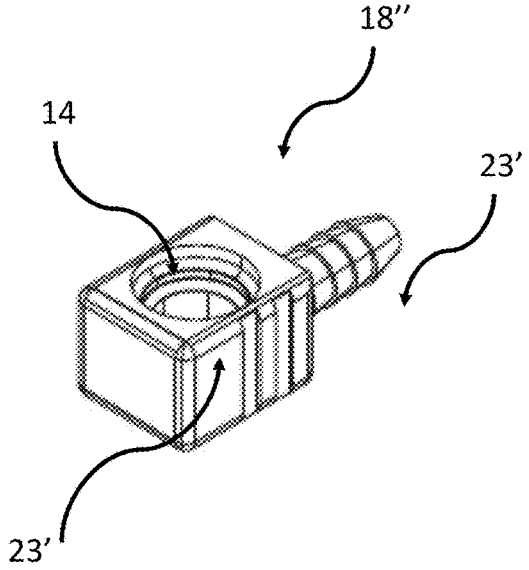
FIG. 21 is a perspective view of a depression member of the two-piece adaptor of FIG. 20.

FIGS. 20 and 21 illustrate another embodiment of a removable adaptor 11" for controlling the dispensing of a beverage. This embodiment includes slide member 18' that slides onto clamp member 17".

The embodiments described herein provide a device and method to easily dispense a beverage stored in a bag-in-box beverage container at a remote location. Additionally, the embodiments allow for hands-free transportation of a bag-in-box beverage container while enabling a bartender or other individual to remotely dispense a beverage through the operation of a removable adaptor secured to the dispensing valve of a bag-in-box beverage container. The device of the invention provides greater efficiency and control to the individual dispensing the beverage from bag-in-box packaging.

While the embodiments have been illustrated and described in detail in the drawings and foregoing description, the same is to be considered as illustrative and not restrictive in character, it being understood that only certain embodiments have been shown and described and that all changes and modifications that come within the spirit of the embodiments are desired to be protected.

What is claimed is:

1. A device for controlling the dispensing of a liquid comprising a removable adaptor for attachment to a liquid dispensing valve, the removable adaptor comprising:

a base comprising an enclosed interior passageway with an inlet and outlet;

a plurality of clamp members constructed and arranged to releasably secure the removable adaptor to the liquid dispensing valve; and a depression member that extends vertically along an anterior portion of the base.

2. The device of claim 1, wherein the plurality of clamp members curve away from opposite sides of the base to form a C-shaped clamp.

3. The device of claim 1, wherein the depression member further comprises a depression extension positionable to depress a push button of the liquid dispensing valve.

4. The device of claim 1, wherein the enclosed interior passageway of the base is positionable to align with the outlet of the liquid dispensing valve when engaged therewith, allowing the free flow of liquid through the base when the liquid dispensing valve is engaged.

5. The device of claim 4, wherein a tube is inserted into the enclosed interior passageway of the base to facilitate the delivery of liquid to a remote location.

6. The device of claim 5, wherein a remote end of the tube is configured to control the amount and timing for the dispensing of the liquid.

7. The device of claim 1, wherein the plurality of clamp members are configured to secure a turn knob liquid dispensing valve in an active dispensing position while engaged with the turn knob liquid dispensing valve.

8. A container assembly comprising a container configured to hold liquids, a liquid dispensing valve coupled to the container, and the device of claim 1 coupled to the liquid dispensing valve.

9. The container assembly of 8, further comprising a backpack holding the container to provide the ability to carry and utilize the device hands-free.

10. The device of claim 9, wherein the backpack is adjustable in size.

* * * * *